United States Patent [19]

Darbo

[11] Patent Number: 4,465,191

[45] Date of Patent: Aug. 14, 1984

[54] PERSONAL TABLET DISPENSER

[76] Inventor: Rolf E. Darbo, P.O. Box 2158, Madison, Wis. 53701

[21] Appl. No.: 388,312

[22] Filed: Jun. 14, 1982

[51] Int. Cl.[3] ..... B65D 13/02

[52] U.S. Cl. ..... 206/537; 206/535; 221/91; 221/112; 221/310

[58] Field of Search ..... 206/537, 459, 534, 534.1, 206/534.2, 535, 536, 538, 539; 221/66, 87, 91, 98, 112, 189, 190, 198, 263, 264, 267, 279, 280, 308, 307, 310; 220/345, 351, 346, 356

[56] References Cited

U.S. PATENT DOCUMENTS

| | | | |
|---|---|---|---|
| 243,925 | 7/1881 | La Bau | 206/535 |
| 1,286,810 | 12/1918 | Sheppard | 221/91 |
| 1,890,388 | 12/1932 | Kramlik | 221/310 |
| 2,436,075 | 2/1948 | Orban | 206/535 |
| 2,707,552 | 5/1955 | Matthiesen | 206/538 |
| 2,790,576 | 4/1957 | Lawrence | 220/356 |
| 2,893,599 | 7/1959 | Kay | 221/267 |
| 2,959,317 | 11/1960 | Aldridge | 220/345 |
| 3,162,301 | 12/1964 | Cage, Jr. | 206/535 |
| 3,251,459 | 5/1966 | Lacour | 206/537 |
| 3,527,383 | 9/1970 | Borsum et al. | 221/112 |
| 3,968,902 | 7/1976 | Bachmann | 206/537 |
| 4,054,208 | 10/1977 | Lowe | 206/537 |
| 4,174,048 | 11/1979 | Volpe, Jr. | 206/537 |
| 4,365,713 | 12/1982 | Ekuan | 312/20 |
| 4,381,059 | 4/1983 | Schurman | 206/534 |

FOREIGN PATENT DOCUMENTS

| | | | |
|---|---|---|---|
| 1310851 | 12/1961 | France | 221/307 |
| 177682 | 5/1957 | Sweden | 206/536 |

*Primary Examiner*—Joseph Man-Fu Moy
*Assistant Examiner*—David Fidei
*Attorney, Agent, or Firm*—Howard H. Darbo

[57] ABSTRACT

A tablet dispenser is disclosed having an elongate hand-held core with a plurality of cavities adapted to contain tablets. A sheath is mounted to the core for slideable movement from a position covering all the cavities to another position uncovering all the cavities. A detent mechanism is employed between the sheath and the core for interrupting the sliding movement after each of the cavities has been uncovered. For spatially orienting the tablet dispenser, and without the need to look at it, distinct physical touch indicia is fixed to the dispenser in lengthwise alignment with the tablet cavities.

2 Claims, 13 Drawing Figures

PERSONAL TABLET DISPENSER

BACKGROUND OF THE INVENTION

The present invention relates in general to tablet dispensers, and more particularly relates to a hand-held type of tablet dispenser adapted to be partially inserted into the mouth of a user for immediate and direct deposit of a tablet in the mouth.

There are many instances where a person is required, because of an illness, to carry medicinal tablets to be taken at prescribed times or upon an indication of a need. Exemplary of this situation is a person afflicated with angina pectoris. In this instance, an emergency precipitated by deficient oxygenation of the heart muscles requires an immediate dosage of nitroglycerin which is usually administered personally in a sublingual manner. Since time is of the essence a person must, as of necessity, carry tablets all the time and administer them immediately upon the need thereof. In such emergency situations, a lapse of several minutes without administration of a tablet could be fatal.

It is a conventional practice with persons who must carry drugs in tablet form to keep on their persons such tablets in the original containers or smaller more convenient vials. One drawback with this practice is that such containers are bulky and are not easily carried in one's pockets. Another drawback which can result in dire consequences is that the person must first remove the cap of the container, remove the cotton stuffing and then single out one small pill for oral ingestion. All this may not be easily done especially if the malady sought to be dealt with renders the hands or fingers of a person trembling or shaking and, worse yet, if the container has a lock-proof cap. The foregoing problems are compounded when emergency situations require the user to dispense a tablet in the darkness or while driving. Other obvious problems emerge when a user with poor eyesight must single out one small tablet, and then pick it up and take it.

Other than the situations which involve an emergency as above described, there is also a need for a hand-held tablet dispenser which is convenient, inexpensive, lightweight and pencil-size such that it can be kept in a shirt pocket or purse.

It is a general aim of the present invention to provide a tablet dispenser which is easily carried in one's shirt pocket much as a pen, and which can be pre-loaded with tablets at the user's convenience, and later, with one hand dispense the exact number of tablets directly into the mouth. In this way, the user does not have to separate one pill from the container of pills, nor does one have to pick the pill up with fingers for administering it sublingualy.

The present invention also includes features which permit a tablet to be dispensed without having to visually orient the dispenser so that the tablet can be transferred quickly to the mouth. Moreover, the tablet dispenser of the present invention is constructed such that single tablets are dispensed in seriatim and thus a person can take the exact number of tablets desired by successively dispensing a single tablet a prescribed number of times.

Other advantages and features of the invention will become apparent by referring to the detailed description of the invention which follows below.

SUMMARY OF THE INVENTION

The personal tablet dispenser according to the present invention employs an elongate hand-held core with a plurality of spaced-apart cavities each adapted to contain a single tablet. Slideable along the length of the core by the application of thumb or finger pressure is a sheath which covers all the tablet cavities when moved to one end of the core, and which successively uncovers each tablet cavity when slideably moved toward the other end of the core.

Further provided is a detent mechanism for interrupting the smooth sliding movement of the sheath as it sequentially uncovers each tablet cavity. In this manner, the user is prevented from accidentally dispensing more tablets than desired.

The tablet dispenser of the present invention includes further advantages by being equipped with a shirt-pocker clip or notches formed in the dispenser at particular locations such that the user can immediately identify the spatial orientation of the dispenser so that a tablet can be administered without the need to visually orient it. For ease of construction, the preferred embodiment is constructed of a plastic material coated with a thin layer of opaque substance at the locations which contact the tablets so as to preclude possible deleterious effects of the plastic, as well as the exposure of the tablets to ambient light.

DETAILED DESCRIPTION OF THE INVENTION

Figure 1:
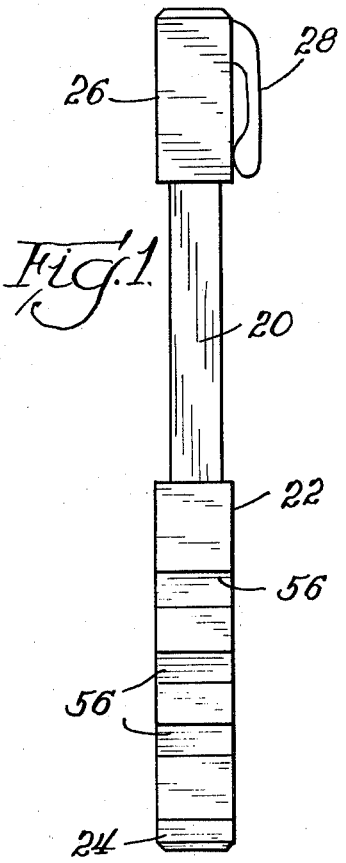
FIG. 1 is a side view of tablet dispenser constructed according to one embodiment of the invention.
Figure 2:
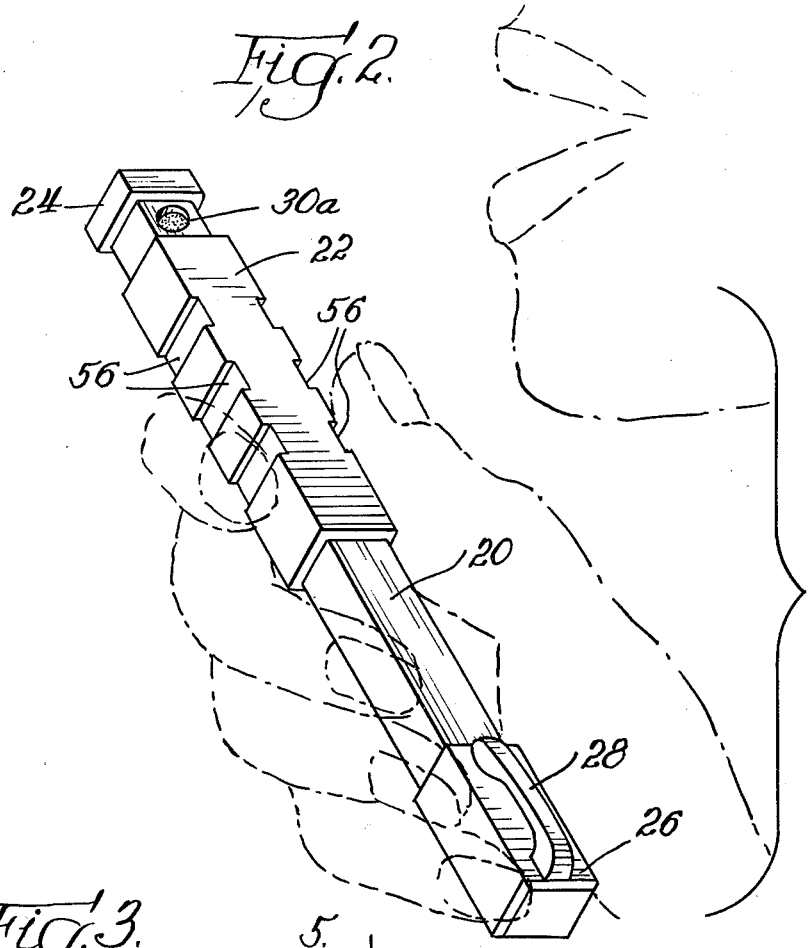
FIG. 2 is an isometric view of the tablet dispenser illustrating how it is held and manipulated when a tablet is to be orally administered.

There is shown in FIG. 1 the personal tablet dispenser constructed in accordance with the principles of the present invention. The general cross-sectional configuration of this embodiment of the invention is square, as depicted in FIG. 2. The dispenser includes as primary components a core 20 with a pluralty of tablet cavities, and a sheath 22 enshrouding the core 20 and slideable between the end caps 24 and 26. The pocket clip 28 conveniently serves as a mechanism to clip the dispenser to a shirt or jacket pocket. The pocket clip 28 serves another more important purpose which will be discussed later.

FIG. 1 of the drawings shows the tablet dispenser as it would appear after the cavities (not shown) have been pre-loaded with tablets and is ready for use. At this juncture it should be noted that the cavities containing tablets in FIG. 2 are located on the core 20 directly under, and thereby covered by the slideable sheath 22

In FIG. 2 there is shown the dispenser after a user has applied thumb and finger pressure to the sheath 22 to slide it away from the small end cap 24 thereby exposing the first tablet cavity 30*a*. The tablet dispenser, being constructed in a pen-like shape, can then be manipulated by one hand so that the tablet contained within the cavity 30*a* can be popped into the user's mouth.

Since it is ordinarily the case that a particular user, as compared to other users, has a prescribed dosage of a particular type of tablet, the tablet dispenser of the present invention can be considered a rather personal item not commonly used by other members of the family. That being the case, a tablet can be administered from the dispenser by simply putting the entire end of the dispenser in one's mouth. Of course, a tablet can also be dispensed into a person's hand and then transferred to the mouth.

It is preferred practice with the described embodiment, as well as those to be described, that once the sheath 22 has been slideably moved to expose a tablet it is left in that position so that when the dispenser is subsequently used the user will not have to hunt for the next tablet-filled cavity.

Figure 3:
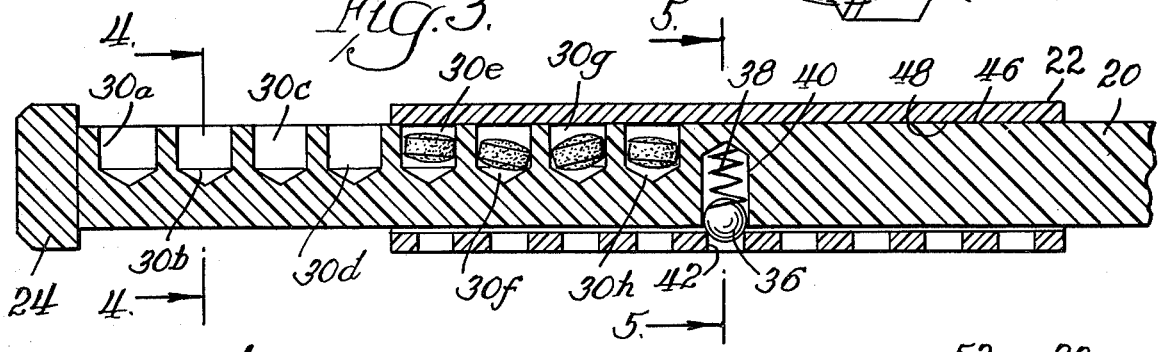
FIG. 3 is a partial sectional side view of the FIG. 1 embodiment showing the tablet cavities and one type of detent mechanism.

With reference now to FIG. 2 and FIG. 3, it can be seen that the sheath 22 is sufficiently long to cover a plurality of cavities, 30*a*–30*h*. It is a simple matter to slide the sheath 22 toward the remote end cap 26 thereby sequentially exposing the remaining tablets. After the dispenser is empty, and at the convenience of the tablet user, additional tablets can be individually dropped into the cavities, and the sheath 22 can be slideably moved against the end cap 24 thereby covering the tablet-filled cavities and preparing the dispenser for use.

For ease of construction, each end cap 24 and 26 is essentially a length of the sheath material cut to a particular length and fastened to the respective ends of the core 20 by a suitable plastic solvent or glue.

In the keeping with the practice of the invention and the realization of its advantages, a detent mechanism is provided, one embodiment of which is shown in FIG. 3. This detent arrangement includes a steel ball 36 and compression spring 38 disposed in a well 40 drilled into the core 20. By this arrangement, the ball 36 is biased against the inside surface of the sheath 22. Within that portion of the sheath which is located on the diametric opposite side of the tablet cavities there are drilled a plurality of spaced-apart detent holes of diameter somewhat smaller than that of the ball 36. The spring thereby urges the detent ball into the spaced-apart holes such that the slideable movement of the sheath 22 is interrupted at each engagement of a detent hole.

While this detent arrangement is well known in the art, certain facets of this embodiment make it well adapted to the present invention. Significantly, the detent holes, one of which is shown as reference character 42, are spaced apart a distance in direct correspondence to the spacing of the tablet cavities. Moreover, the location of the detent holes, as compared to the sheath edge 44 is important insofar as such edge 44 should be disposed between tablet cavities when the detent ball 36 is engaged with one of the detent holes 42.

For the sake of completeness, the detent ball and spring are first installed in the detent well, the sheath is then slid over the detent arrangement, and lastly the end cap 24 is attached to the core.

With this construction it is assured that when the sheath 22 is slideably moved from one detent position to another, only one tablet cavity becomes uncovered. Also, the user need not visually ascertain whether the sheath has been moved a specified distance to uncover a tablet, but rather need only feel with the fingers the pressure differential in moving the sheath 22 from one detent hole to another. This aspect of the invention facilitates, to a high degree, the use of the tablet dispenser in darkness, or while driving a vehicle.

Another feature of this detent arrangement provides a tight-fitting seal between the inner sheath surface 46 and the outer core surface 48 and thereby prevents an exchange of air or moisture between the environment and the cavities containing tablets. It is known that the shelflife of many medicinal tablets is reduced when freely exposed to the atmosphere or moisture. While the seal between the sheath surface 46 and the core surface 48 is not a hermetic-type seal, it should be appreciated that the close-fitting nature of these surfaces prevents a free exchange of air between the tablet cavities and the atmosphere and therefore the deleterious effects thereof on the tablets are reduced.

Figure 4:
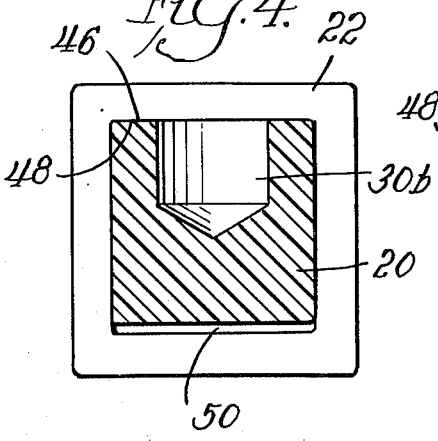
FIG. 4 is a sectional view taken along line 4—4 of FIG. 3, showing how the sheath enshrouds the core so as to make the tablet cavities somewhat airtight.
Figure 5:
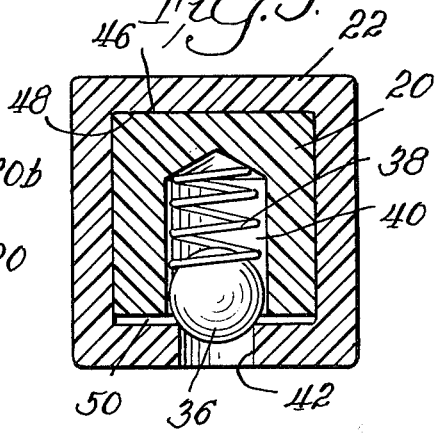
FIG. 5 is a sectional view taken along line 5—5 of FIG. 3, specifically showing the ball and spring detent arrangement.

With regard to this tablet cavity sealing feature brief reference should be made to FIGS. 4 and 5. It can be seen from these figures that the internal cross-sectional configuration of the sheath 22 conforms to that of the core 20. These elements are preferably constructed so that the sheath 22 freely slides, except for the detent arrangement, on the core 20. A small gap 50 exists between one core surface and the corresponding internal sheath surface so that the detent arrangement is effective in applying a bias force between the core 20 and sheath 22 such that the respective surfaces 48 and 46 are maintained in close contact to prevent the free exchange of air as before described.

Figure 6:
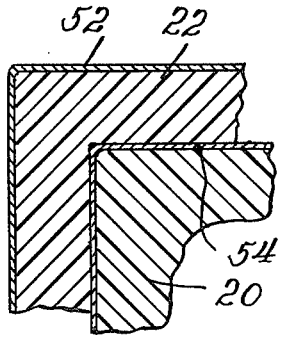
FIG.6 is a partial sectional view of a portion of the sheath and core showing the surfaces which are plated with an opaque substance.

A related aspect of the present invention is shown in FIG. 6. Because sunlight or artificial light is known to also produce deleterious effects on some tablets, certain surfaces of the tablet dispenser are coated with an opaque substance, such as for instance a monomolecular layer of aluminum. In the preferred embodiment the aluminum layer is coated with lacquer to provide a durable exterior finish. Other opaque substances may, of course, be employed. The aluminum may be selectively deposited or plated especially to the outer surface 52 of the sheath 22 and the end cap 24, as well as the core surfaces 54 proximate the tablet cavities. Those skilled in the art may find it economically advantageous to plate the entire surface of every dispenser element, rather than selectively plating certain surfaces. Indeed, it is well within the purview of the present invention to alternatively utilize a colored plastic to achieve the foregoing advantages. In this vein also, an opaque inert substance deposited within the tablet cavities may prevent reactions that could occur between the tablet and the type of plastic employed in constructing the tablet dispenser.

In accordance with another aspect of the present invention, and with reference back to FIG. 2, sheath grooves (one shown at 56), are provided for spatially orienting the dispenser by the feel of such grooves with the fingers or thumb. In association with these grooves, the pocket clip 28 plays an equally important role in that the clip is located on the same dispenser side as the tablet cavities and thus by the feel of the clip, the user knows that the tablet dispenser is properly oriented such that a tablet will not inadvertently fall out before the dispenser end is inserted into the mouth. The presence of the pocket clip 28 can be felt by the heel of the hand at the same time the fingers and thumb are searching for the sheath grooves 56. From FIG. 2 it is seen that the end cap 26 is substantially longer than that of 24. As an additional aid this aspect permits the user to quickly determine at which end of the dispenser the tablets are contained.

In brief review, it is seen that the structural aspects of the invention permit a person, while driving or in the dark, to quickly orient the tablet dispenser without the need of the visual sense. It should be understood, however, that those skilled in the art may prefer other indicia capable of being ascertained by the touch or feel, for properly orienting the tablet dispenser.

Figure 7:
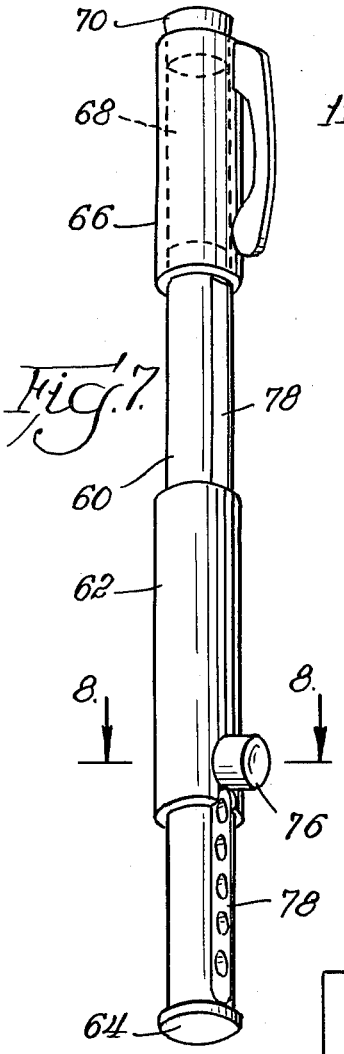
FIG. 7 is an isometric view of another embodiment of the tablet dispenser according to the principles of the present invention.

Moving now to FIG. 7, there is shown another embodiment exemplary of the principles of the present invention. Particularly, this embodiment has a cross-sectionally round configuration, much like that of a fountain pen. As before, this embodiment includes a round core 60 over which a sheath 62 is mounted for slideable movement. Provided also, are end caps 64 and 66 which act as stops for limiting the slideable movement of the sheath 62. However, the large end cap 66 includes a hollow reservoir 68 therein for storing additional tablets. A stopper 70, such as a cork, is squeezed into the reservoir opening for the obvious reason of preventing the additional tablets from being spilled.

Figure 8:
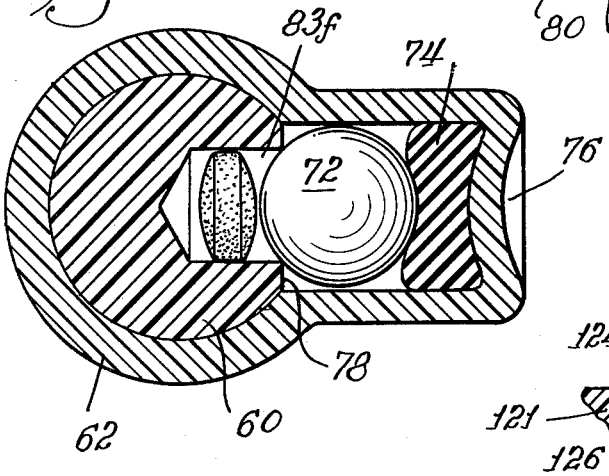
FIG. 8 is an end sectional view taken along line 8—8 of FIG. 7 illustrating the use of the tablet cavities as part of the detent mechanism.

FIG. 8 illustrates the cross-sectional configuration of this embodiment, and particularly the engagement of the detent ball with the tablet cavities in contrast with the detent arrangement shown above in FIG. 3. In addition, this detent utilizes an elastomeric silicon sponge rubber piece 74 for urging the ball 72 into engagement with the cavities. The ball 72 and elastomeric element 74 are enclosed in the push knob 76 (FIG. 7) which knob conveniently allows thumb pressure to be applied to it to slide the sheath 62.

Shown in FIG. 7 is a flattened surface area 78 surrounding all the tablet cavities. There is a corresponding flat surface on the inner side of the sheath 62 for providing a sealing contact between the two surfaces the purpose of which was described before. It is apparent that this embodiment of the invention achieves an economy in construction in that the tablet cavities also serve as the detent holes. The push knob 76 is also easily found with the touch of the thumb to facilitate the orientation of the dispenser.

Figure 9:
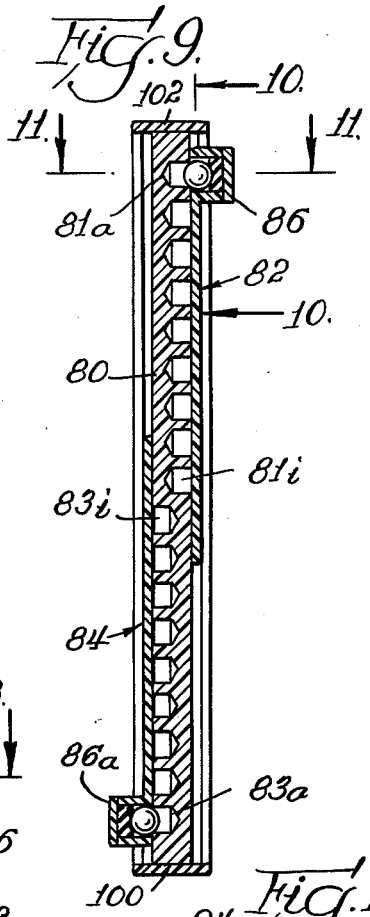
FIG. 9 is yet another embodiment of the invention illustrating two sets of tablet cavities and slideable covers on opposite sides of the tablet dispenser.
Figure 11:
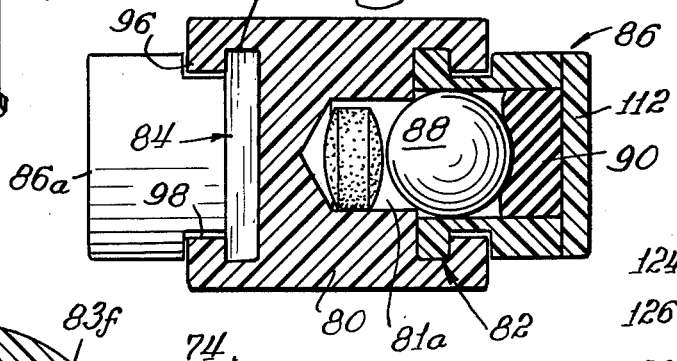
FIG. 11 is an end sectional view of FIG. 9, taken along line 11—11 thereof.

FIG. 9 is yet another embodiment of the invention which incorporates the detent arrangement shown in FIG. 7, i.e., the tablet cavities serving as detent holes. The cross-sectional configuration of this embodiment is square and is generally shown in FIG. 11. This tablet dispenser holds about twice the number of tablets as those embodiments described previously, and does so by utilizing a set of tablet cavities at each end of the core 80, and a separate slider cover 82 and 84 for slideably covering and uncovering each such cavity set. In FIG. 11, it is seen that one slider push knob 86 houses one detent ball 88 which is biased into engagement with the tablet cavities of one set **81*a*–81*i* by an elastomeric element 90. On the diametric opposite side of the core is disposed the other corresponding set of tablet cavities, 83*a*–83*i*, covered by an associated slider cover 84. Push knob 86*a* on this slider comparably houses elastomeric element 90*a* and detent ball 88*a* for engagement into the tablet cavity 83*a*–83*i* openings. Slider cover 84 acts as a flange which fits into a core channel 94 in such a manner that the cover 84 is slideably fixed within the core. Shoulders 96 and 98 prevent the slider flange from coming out of the core channel 94. Slider cover 82 is comparably constructed for slideable movement along the core 80. End caps 100 and 102** are employed to maintain each slider within its grooved channel.

Figure 10:
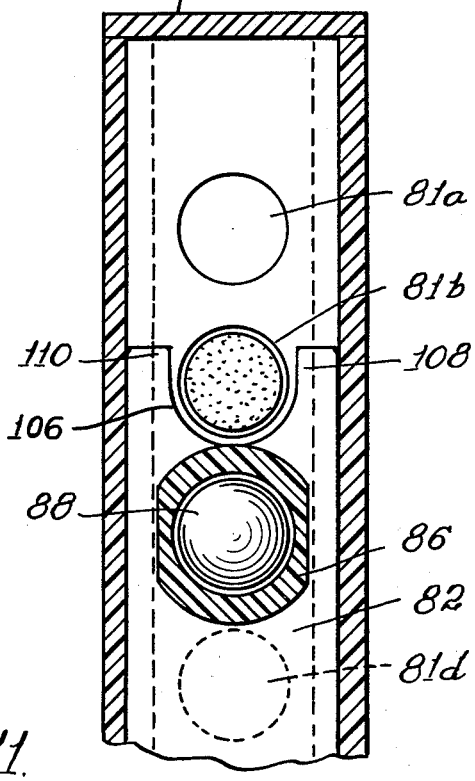
FIG. 10 is a partial sectional view of FIG. 9, taken along line 10—10 thereof.

In FIG. 10, there is shown slider cover 82 moved to a position uncovering tablet cavity **81*b*. The slider 82 further includes a U-shaped end 106 with a concavity which is larger than the tablet cavity opening, with ends 108 and 110 which abut the end cap 102 when the slider is moved to a position covering all the tablet cavities 81*a*–81*i*. A cap 112 (FIG. 11**) is cemented on the push knob top after the detent ball and elastomeric element have been installed therein.

Figure 13:
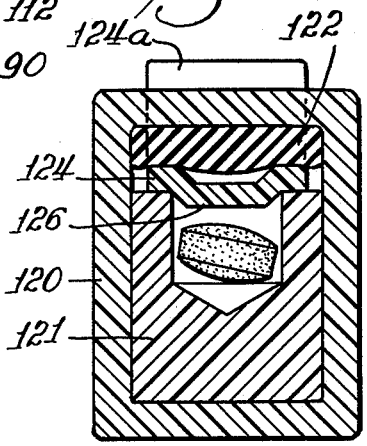
FIG. 13 is an end sectional view of FIG. 12, taken along line 13—13 thereof.
Figure 12:
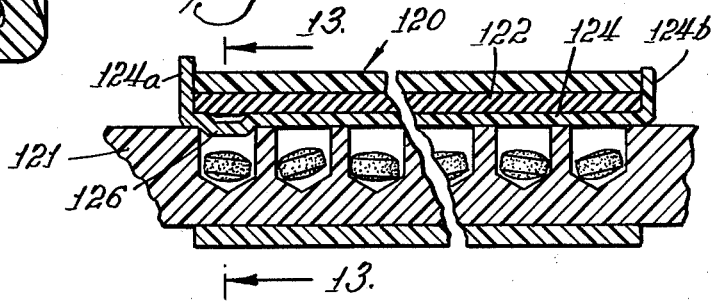
FIG. 12 is a sectional view of the tablet dispenser with another embodiment of a sheath and detent combination for sealing the covered tablet cavities.

In FIG. 12, there is shown yet another embodiment of a detent arrangement with an improved seal for the tablet cavity openings. The sheath 120 encircles the core 121 and slides in association with an elongate elastomeric pad 122 and an elongate detent plate 124. The detent plate 124 has ends **124*a* and 124*b* turned upwardly for capturing therebetween the sheath so that when finger pressure is applied to the protruding upturned end 124*a*, the sheath slides with the detent plate 124. The upturned end 124*a* protrudes sufficiently above the surface of the sheath 120 to act as a push knob, as before described, as well as an indicator of the orientation of the tablet dispenser. The detent plate 124 includes a raised part 126 which functions as a detent male element similar to the ball as described above. The detent plate 124 with the raised part 126 are clearly seen in FIG. 13. The raised part 126 closely conforms in shape to the tablet cavity opening and thereby tightly closes it off to atmospheric exposure. The remaining cavities are tightly closed off by the elastomeric pad 122 pressing the detent plate 124 firmly into contact with the cavity openings, as shown in FIG. 12**.

Having set forth the features and principles of the present invention, it should now be apparent that the tablet dispenser is easily carried by the user, and can be quickly spatially oriented for dispensing a tablet should an emergency situation be imminent. Upon making a determination of a proper orientation, the user can administer a single tablet by sliding the sheath to uncover the first or next still loaded cavity. It is not necessary to return the sheath to initial fully closed position after each tablet has been dispensed. The user can reload the dispenser when all, or nearly all, of the cavities have been emptied.

It should be understood that other variations and arrangements of the present invention may be devised by those skilled in the art. Indeed, it may be desired to enlarge the tablet cavities to hold two, three, etc. tablets each thereby permitting one to dispense multiple tablets on the uncovering of a single cavity. Although various embodiments of the invention have been described in detail, it should be understood that various changes, substitutions and alterations can be made therein without departing from the spirit and scope of the invention as defined by the appended claims.

I claim:

1. A personal hand-held tablet dispenser, comprising:

an elongate core having an end stop at each end thereof and a plurality of tablet cavities axially aligned along one-half of said core;

a sheath enshrounding said core and being responsive to finger pressure for movement between each said end stop, said sheath having a length such that when it abuts one said end stop it covers said plurality of cavities, and when said sheath abuts the other end stop said plurality of cavities are uncovered;

detent means acting between said core and said sheath for releasably latching said sheath to said core after each cavity of said plurality of cavities has been uncovered by said sheath being moved; and a protruding member above the general surface of the combined core and sheath elements and located in a predetermined location with respect to said plurality of cavities so that the spatial orientation of said dispenser can be readily identified by the feel of said member.

2. A persomal hand-held tablet dispenser adapted for dispensing tablets using one hand, comprising;

an elongate core having along one side thereof a plurality of in line spaced-apart cavities each for storing a tablet and each having a peripheral area therearound, and having an end defining a part by which said dispenser can be held by one's hand;

a sheath in close-fitting contact with said peripheral surface areas and having a length shorter than said core and mounted on said core for movement by the fingers of the hand of a user from a first location covering all said plurality of cavities to successive locations whereby each said cavity is successively uncovered and said sheath does not extend beyond the end of said core; and detent means for releasably latching said sheath to said core at each of said locations and for biasing said sheath in close-fitting contact with said peripheral surface areas, said detent means further including a plurality of spaced-apart detent holes in said sheath, a well disposed in said core on the diametric side opposite said plurality of cavities, a detent ball and resilient means housed in said well for biasing said detent ball into engagement with the plurality of detent holes in said sheath.

* * * * *